US008033066B2

(12) United States Patent
Griffiths

(10) Patent No.: US 8,033,066 B2
(45) Date of Patent: Oct. 11, 2011

(54) WALL PANEL SYSTEM WITH INSERT

(75) Inventor: Robert T. Griffiths, Elk River, MN (US)

(73) Assignee: Firestone Diversified Products, LLC, Indianapolis, IN (US)

( * ) Notice: Subject to any disclaimer, the term of this patent is extended or adjusted under 35 U.S.C. 154(b) by 265 days.

(21) Appl. No.: 12/416,244

(22) Filed: Apr. 1, 2009

(65) Prior Publication Data

US 2009/0241451 A1 Oct. 1, 2009

Related U.S. Application Data

(60) Provisional application No. 61/041,449, filed on Apr. 1, 2008.

(51) Int. Cl.
*E04B 2/00* (2006.01)

(52) U.S. Cl. ..... 52/235; 52/506.08; 52/510

(58) Field of Classification Search ..... 52/235, 52/506.01, 506.06, 506.08, 510, 512, 489.1, 52/FOR. 148, 586.1, 741.1
See application file for complete search history.

(56) References Cited

U.S. PATENT DOCUMENTS

| | | | | |
|---|---|---|---|---|
| 2,914,936 | A * | 12/1959 | Reinold | 52/522 |
| 3,073,420 | A | 1/1963 | Olsen | |
| 3,672,107 | A * | 6/1972 | Santry et al. | 52/235 |
| 4,483,122 | A * | 11/1984 | Crandell | 52/747.1 |
| 4,580,385 | A | 4/1986 | Field | |
| 4,759,157 | A | 7/1988 | Webb et al. | |
| 4,780,995 | A | 11/1988 | Gittins | |
| 4,796,403 | A | 1/1989 | Fulton et al. | |
| 4,798,033 | A | 1/1989 | Weidl | |
| 4,800,689 | A | 1/1989 | Lane | |
| 4,843,791 | A * | 7/1989 | Michlovic | 52/235 |
| 4,848,045 | A | 7/1989 | Nichols et al. | |
| 4,866,896 | A * | 9/1989 | Shreiner et al. | 52/235 |
| 4,890,426 | A | 1/1990 | Hickman et al. | |
| 4,964,248 | A | 10/1990 | Braine et al. | |
| 4,969,250 | A | 11/1990 | Hickman et al. | |
| 5,031,367 | A | 7/1991 | Butzen | |

(Continued)

FOREIGN PATENT DOCUMENTS

GB 2148970 A * 6/1985

(Continued)

OTHER PUBLICATIONS

Product Specifications 108 Series 1/8" Vinyl Foam Tape, Engineered Materials Inc. 2859 84th Lane NE, Blaine, MN 55449, undated.

*Primary Examiner* — Robert Canfield
*Assistant Examiner* — Brent W Herring
(74) *Attorney, Agent, or Firm* — Jason A. Houser; Arthur M. Reginelli

(57) ABSTRACT

A wall panel system including a mounting bracket, a wall panel, and a clip attached to the wall panel, the clip having an engaging element that secures it to the mounting bracket. The wall panel system also includes a slot in the clip facing outwardly from the wall panel, a spline slidably positioned in the slot of the clip, and a sealing insert positioned between the mounting bracket and the spline. The sealing insert may be in the shape of an X, and may be made from polypropylene foam. The sealing insert may also have a gasket tape on one side to provide an improved seal.

17 Claims, 5 Drawing Sheets

U.S. PATENT DOCUMENTS 5,222,341 A 6/1993 Watkins et al.
5,239,791 A 8/1993 Mills, Jr. et al.
5,251,411 A 10/1993 Kelley et al.
5,263,292 A * 11/1993 Holland et al. ..... 52/235
5,272,846 A 12/1993 Kelley et al.
5,289,662 A 3/1994 Castle
5,414,965 A 5/1995 Kelley et al.
5,687,524 A * 11/1997 Ting ..... 52/461
5,709,056 A * 1/1998 Matsuyama et al. ..... 52/235
5,845,440 A * 12/1998 Matsuyama et al. ..... 52/235
5,893,245 A * 4/1999 Sekiguchi et al. ..... 52/235
5,893,247 A 4/1999 Hickman et al.
5,927,023 A 7/1999 Kittilstad
5,934,033 A * 8/1999 Matsuyama et al. ..... 52/235
6,035,598 A * 3/2000 Sukolics et al. ..... 52/506.08
6,216,408 B1 4/2001 Davidson
6,434,853 B2 8/2002 Pyburn
6,442,904 B1 9/2002 Ortiz
6,442,907 B1 * 9/2002 Doyon et al. ..... 52/235
6,578,322 B2 6/2003 Kintop
6,606,828 B1 8/2003 Lin et al.
6,745,527 B1 * 6/2004 Sherman et al. ..... 52/235
6,748,709 B1 * 6/2004 Sherman et al. ..... 52/235
6,786,018 B2 9/2004 Webb et al.
6,845,590 B1 1/2005 Mills, Jr.
6,912,813 B2 7/2005 Grizenko
6,912,814 B1 7/2005 Inzeo
6,945,005 B2 9/2005 Nunley
7,059,086 B2 6/2006 Edvardsen
7,134,247 B2 * 11/2006 Ting ..... 52/235
7,562,509 B2 * 7/2009 Ness ..... 52/800.11
7,614,191 B2 * 11/2009 Mitchell ..... 52/235
7,716,891 B2 * 5/2010 Radford ..... 52/506.08
2006/0179744 A1 * 8/2006 Lynch et al. ..... 52/235
2006/0265961 A1 * 11/2006 Winborn et al. ..... 49/502
2007/0022682 A1 * 2/2007 Morgenegg et al. ..... 52/235
2008/0134594 A1 * 6/2008 Ness ..... 52/200

FOREIGN PATENT DOCUMENTS

JP 05331939 A * 12/1993

* cited by examiner

WALL PANEL SYSTEM WITH INSERT

This application gains the benefit of U.S. Provisional Application No. 61/041,449 filed Apr. 1, 2008, which is incorporated herein by reference.

FIELD OF THE INVENTION

One or more embodiments of this invention relate to an architectural wall panel system designed to cover an interior or exterior building surface. More particularly, one or more embodiments of this invention relate to an architectural wall panel system with a foam closure for sealing the wall panel system to prevent water and air infiltration.

BACKGROUND OF THE INVENTION

Architectural wall panel systems, including both metal and composite wall panel systems, have been used extensively for some time, primarily in the commercial and industrial building markets. In recent years the popularity of composite wall panel systems, in particular, has been increasing steadily. There are a number of factors that may be credited for the wide-spread and increased use of such wall panel systems. One such factor is the high cost to construct commercial and industrial buildings, which tend to be relatively large, from stone or brick. Wood is not a suitable substitute due to the large loads the buildings supporting structure must withstand. Another factor effecting the increased use of metal and composite wall panel systems is the high durability of the systems. Both the metals and composites used to make the panels for wall panel systems are highly resistant to damage from sun, dirt, moisture, fire, and many other environmental elements. Consequently, the metal and composite wall panel systems have a long life, and may require less maintenance than other alternative building materials and systems.

Architectural wall panel systems can generally be placed into one of two categories: face-sealed architectural panel systems or vented rain-screen architectural panel systems. Face-sealed architectural panel systems include those systems that have a sealant in both the horizontal and vertical joints between adjacent wall panels. The sealants make the wall panel system impermeable to air and water, and may include caulking, gaskets, or other sealants with a similar function. Vented rain-screen architectural panel systems are those systems designed to allow permeability through the joints between adjacent wall panels. The permeable joints allow for breathability and rapid pressure equalization within the wall panel system to prevent pressure buildups behind the wall panels.

Architectural wall panel systems have many advantages, as discussed above, however, these systems may also present a number of challenges and disadvantages. One such challenge is the thermal expansion and contraction of the wall panels. The metal and composite materials most commonly used in architectural wall panel systems are subject to natural expansion and contraction due to changes in atmospheric conditions, including heat and humidity. If a means of accommodating this inherent thermal cycling is not provided in the attachment system of the architectural wall panel system then the panels can become warped and cracked, requiring repairing or replacement. Another challenge that may be associated with architectural wall panel systems is directly related to the first issue of thermal cycling, and relates to the effectiveness of sealants used in joints between adjacent wall panels in face-sealed architectural panel systems. Because the joints increase and decrease in size during thermal cycling, sealants often become dislodged and/or cracked and are thereafter ineffective at preventing the infiltration of air and water. As a result, sealants used in face-sealed architectural panel systems have proven disappointingly ineffective.

Another disadvantage associated with many architectural wall panel systems is the complexity of the system, including the number of pieces and parts needed and the extensive time and labor required to install the complex system. In particular, where a form of attachment clips are used to secure the wall panels to the substructure, each clip must typically be fastened to the wall panel and to the substructure, either directly or indirectly. This means that if an extremely high number of fasteners are used, it results in a great deal of time and effort spent in installation of the systems just to secure the clips to the panels prior to attaching the panels to the structure.

A number of different attachment systems have been introduced and employed in an attempt to overcome the challenges and alleviate the disadvantages discussed above. One known attachment system includes a plurality of locking members secured directly to, or formed integrally with, the outer surface of the return flanges of wall panels. The locking members secure the panel to a retaining member, which is itself secured to a surface of a building structure. The locking members are shaped such that they may be forced into a channel, but cannot be removed from that channel, such as angled surfaces with an apex adjacent the retaining member that resemble half of an arrowhead. The system may also optionally provide a drainage channel to carry water and other debris away from the surface of the building structure. While this attachment system allows for more efficient installation of an architectural wall panel system, it suffers from the disadvantage mentioned above relating to thermal cycling of the wall panel system because it does not allow for movement of the wall panels. In addition, the attachment system suffers from a number of new disadvantages, such as not providing adequate attachment strength to withstand some natural weather conditions, and making it extremely difficult to repair or replace installed wall panels as the locking members prevent the panel from being removed from the retaining members.

Other known attachment systems for securing wall panels of an architectural wall panel system to a building surface utilize some form of an insert wedged between the two adjacent flanges of adjacent wall panels, while the flanges are received in a channel. The insert is secured between the two flanges by a fastener, and fits snuggly therebetween to provide a seal against water and air infiltration. The insert may be made of an elastomeric material to allow for thermal expansion and contraction of the wall panels. This system, however, uses a high number of parts, and the thermal cycling of the system is limited by the small amount of movement allowed by the elastomeric insert. Furthermore, the elastomeric insert is subject to wear from the natural elements it will be exposed to, and subject to failure due to these elements and repeated expansion and contraction as a result of the thermal cycling of the wall panel system.

Additional attempts at improved attachment systems have included attachment systems utilizing variously shaped flanges extending along at least one edge of the wall panel to facilitate attachment of the panel to a building surface; attachment systems using rotatable retaining members secured to the mounting surface that rotate between a first (narrow) position designed to allow placement of the wall panels and a second (broad) position extending into slots in the wall panel flange to secure the panel in place, such as, for example, a T-shaped retaining member that rotates about an axis parallel to the wall panel flanges; and attachment systems having vents and filler strips which slide into grooves and are positioned within the gaps between adjacent wall panels to provide a watertight seal while allowing air flow therethrough. None of these attachment systems has proven noticeably advantageous over conventional attachment methods in providing a more efficient, reliable, and practical means of attaching architectural wall panels to the surface of a structure.

There is therefore a need for an improved architectural wall panel system, and specifically an improved attachment system for attaching architectural wall panels, that alleviates one or more of the disadvantages discussed herein.

DETAILED DESCRIPTION OF ILLUSTRATIVE EMBODIMENTS

In one or more embodiments of the present invention an architectural wall panel system (hereinafter referred to as wall panel system) is provided, and is generally indicated by the numeral 20 in FIG. 1. With reference to FIG. 2, an exemplary wall panel system 20 is shown as installed on a building surface 24. Wall panel system 20 includes a plurality of wall panels 22 positioned adjacent to one another on a surface, such as building surface 24 (FIG. 2). While reference will be made herein to building surface 24, it should be appreciated that wall panel system 20 may be used on any desired surface, whether interior or exterior, and reference to building surface 24 should not be interpreted as limiting the scope of the invention.

Wall panels 22 may be made of any suitable material that has the strength and wear characteristics to withstand the natural forces and elements that act upon the wall panel system. Such materials will be readily apparent to a person of ordinary skill in the art. In one or more embodiments, wall panels 22 may be made of metal, and in a preferred embodiment wall panels 22 are made of aluminum. In another embodiment, wall panels 22 may be made of a composite material. Wall panels 22, as shown in the figures, have a rectangular shape, however other shapes may be employed without deviating from the scope of the invention.

Figure 1:
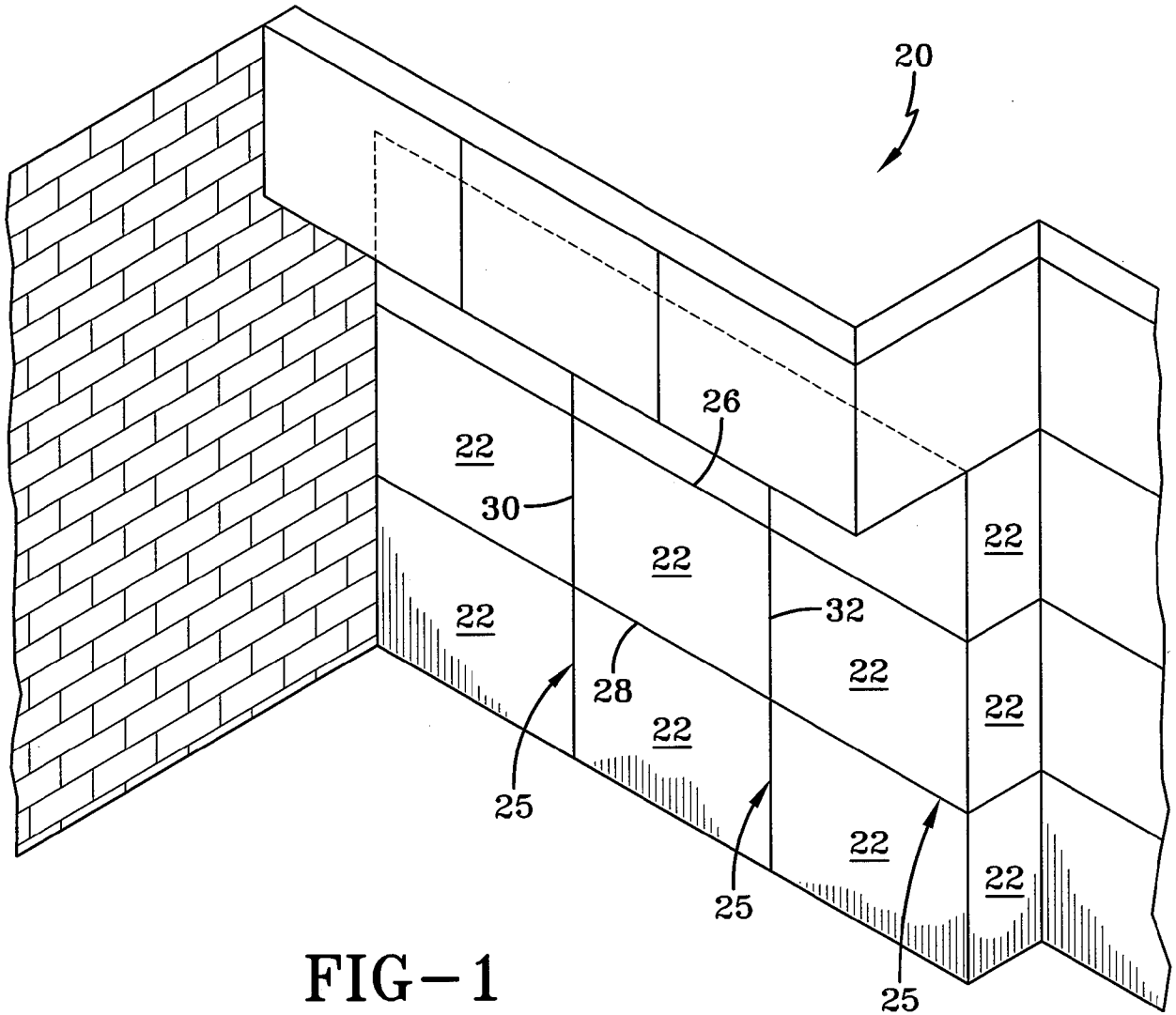
FIG. 1 is a perspective view of a wall panel system according to the concepts of at least one embodiment of the present invention.
Figure 2:
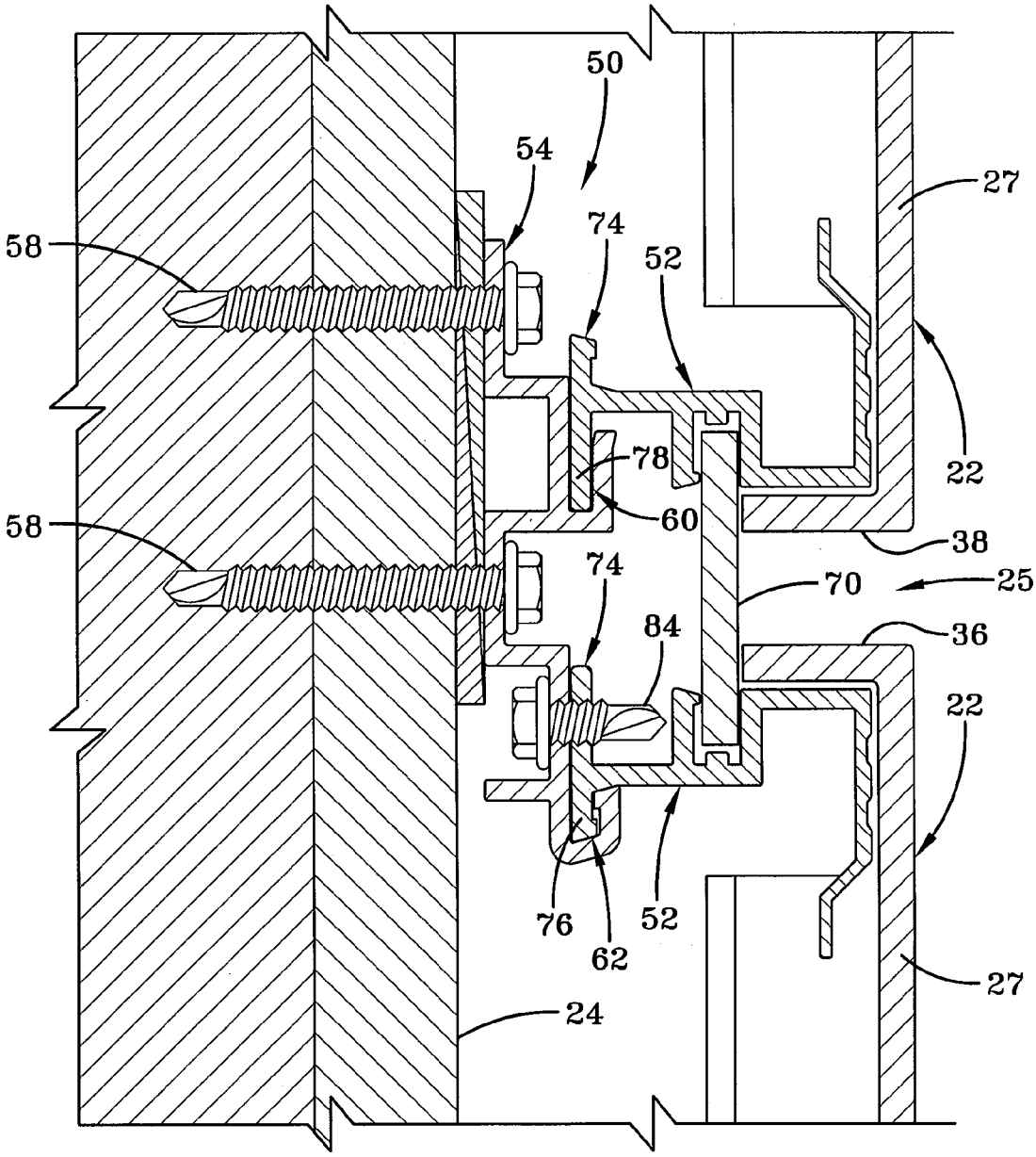
FIG. 2 is a sectional view of a portion of the wall panel system of FIG. 1.

Referring to FIGS. 1 and 2, wall panels 22 are positioned adjacent to one another with a gap, generally indicated by the numeral 25, therebetween to facilitate installation and thermal cycling, as will be discussed in greater detail below. Each wall panel 22 has a top edge 26, a bottom edge 28, a left side edge 30, and a right side edge 32. Gaps 25 are formed between the adjacent edges of two panels, such as, for instance, a horizontal gap 25 between top edge 26 of a lower panel and bottom edge 28 of a top panel positioned immediately above the lower panel. Similarly, vertical gaps 25 are formed between a left side edge 30 and a right side edge 32 of adjacent panels. As is apparent from FIG. 1, wall panel system 20 may be adapted to be used to cover inside and outside corners, soffits, copings, window peripheries, and other architectural features that may be present on building surface 24. In one or more embodiments the adaptation of wall panel system 20 to the architectural features of building surface 24 may be accomplished by varying the dimensions of wall panels 22. Thus, in at least one embodiment of the invention, wall panels 22 may be of different shapes and sizes as needed to properly cover building surface 24.

In one or more embodiments, wall panel 22 is generally pan shaped having a body portion 27 and side portions, also referred to as side flanges or flanges, extending from the edges of body portion 27. Body portion 27 may have any desired size, depending upon the desired appearance of wall panel system 20 and the engineering design constraints relating to wind forces and other such factors that may limit the dimensions of wall panel 22 in one or more ways. In one or more embodiments, such as the embodiment shown in the figures with a rectangular shaped wall panel 22, body portion 27 may have a height, or distance between top edge 26 and bottom edge 28, of between approximately 3 inches and 72 inches, in other embodiments between approximately 6 inches and 60 inches, and in still other embodiments between 6 inches and 48 inches. Similarly, body portion 27 may have a width, or distance between left side edge 30 and right side edge 32, of between approximately 3 inches and 180 inches, in other embodiments between approximately 6 inches and 144 inches, and in still other embodiments between 6 inches and 120 inches.

The height and width of wall panel 22 may differ, creating a rectangular shaped body portion 27, or they may be equal, thereby making body portion 27 square in shape. In one or more embodiments wall panel 22 may have a depth of between approximately 0.5 inches and 6 inches, in other embodiments a depth of between 0.5 and 3 inches, and in a preferred embodiment a depth of approximately 0.875 inches. Wall panel 22 may also include one or several of a variety of finishes or textures to provide a desired appearance, as is well known in the art.

The side flanges of wall panel 22 extend a relatively short distance from body portion 27, as compared with the overall dimensions of wall panel 22. The flanges extend from each edge so that top edge 26, bottom edge 28, left side edge 30, and right side edge 32 each has a flange extending therefrom, including top flange 36 and bottom flange 38. In one or more embodiments the flanges may be connected at the corners of body portion 27, and in other embodiments a gap may exist between adjacent flanges at the corners of body portion 27.

Figure 4:
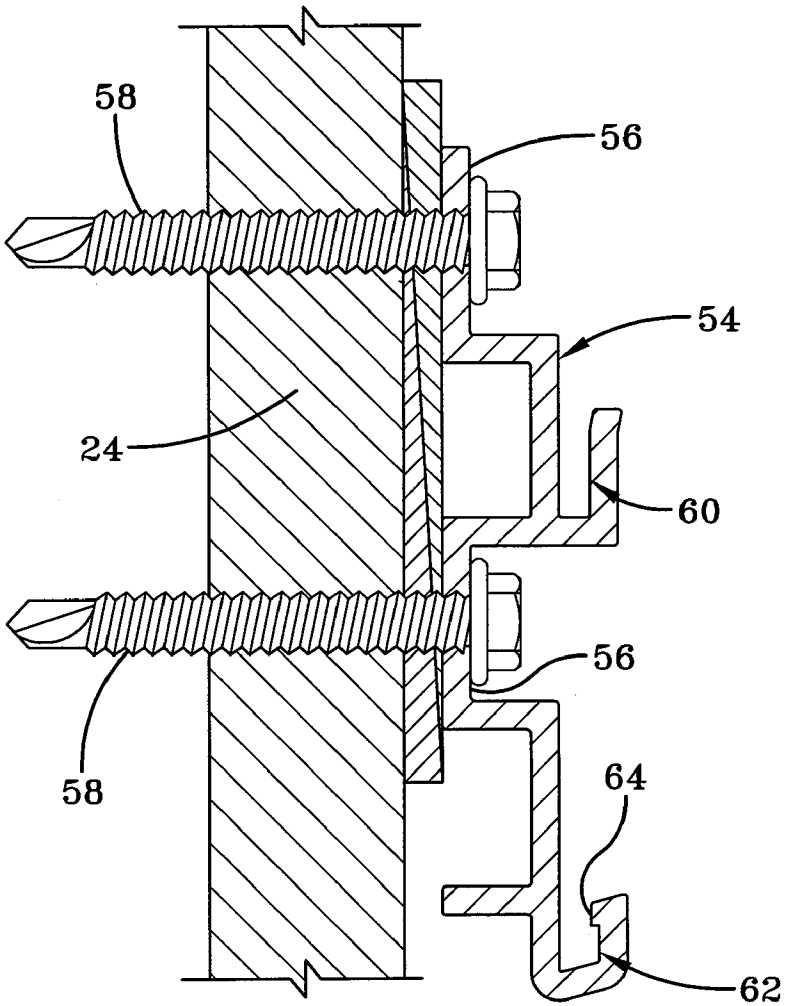
FIG. 4 is a sectional view of a mounting bracket secured to a wall surface according to at least one embodiment of the present invention.

The attachment system 50 used to secure wall panels 22 to building surface 24 is shown in FIG. 2. As can be seen, attachment system 50 includes clips, generally indicated by the numeral 52, attached to wall panel 22, and a mounting bracket, generally indicated by the numeral 54, attached to building surface 24 in which clips 52 are selectively secured. In one or more embodiments, mounting bracket 54 includes a pair of planar surfaces 56 to facilitate attachment to building surface 24, as can best be seen in FIG. 4. A fastener 58 passes through each planar surface 56 and into building surface 24 to secure mounting bracket 54 in a desired location. In at least one embodiment, fasteners 58 are self-tapping screws that require no pre-drilling of either mounting bracket 54 or building surface 24.

Mounting bracket 54 includes a top channel 60 that receives a portion of a clip 52 attached to the bottom flange of a wall panel 22, as will be discussed in greater detail below. Top channel 60 is generally U-shaped, and is displaced outwardly from building surface 24. Mounting bracket 54 also includes a bottom channel 62 that is positioned below top channel 60, and which is also displaced outwardly from building surface 24. Bottom channel 62, like top channel 60, is generally U-shaped and is adapted to receive a portion of a clip 52 attached to the top flange of a wall panel 22. In one or more embodiments, bottom channel 62 may include a protrusion 64 within the U-shaped channel and extending toward building surface 24 on the upper end of the channel. Protrusion 64 helps to maintain clip 52 within bottom channel 62, as will be discussed hereinafter.

Figure 3:
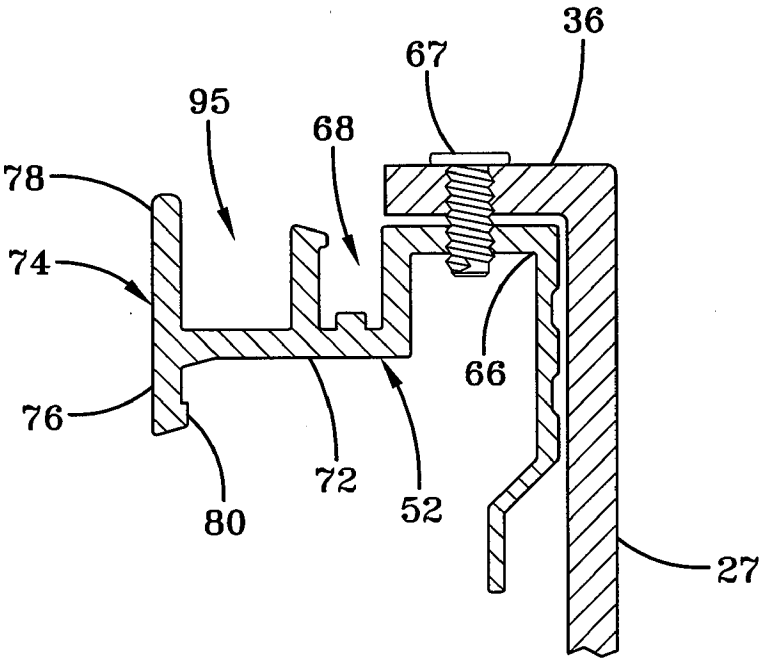
FIG. 3 is a sectional view of a clip secured to a wall panel flange according to the concepts of at least one embodiment of the present invention.

Clip 52 is attached to wall panel 22, preferably by a single fastener. In one or more embodiments, clip 52 may be between approximately 0.5 and 5.0 inches wide, in other embodiments clip 52 may be between 2.0 and 4.0 inches wide, and in a preferred embodiment clip 52 may be approximately 3.0 inches wide. In one or more embodiments, a right-angled portion 66 of clip 52 rests in the corner created by top flange 36 and body portion 27 of wall panel 22, as best seen in FIG. 3. It should be appreciated that right-angled portion of clip 52 may also be positioned in the corners created by the intersections of bottom flange 38 and the side flanges with body portion 27 of wall panel 22, as desired. The pairing of right angled portion 66 and the corners of wall panel 22 help to maintain clip 52 in the proper position and provide additional strength to wall panel system 20. A fastener 67 is provided through flange 36 and right-angled portion 66 of clip 52 to attach clip 52 to wall panel 22 (FIG. 3).

In at least one embodiment, clip 52 further includes a slot 68 adjacent the end of flange 36, or one or several of the other flanges. Slot 68 faces outwardly from wall panel 22 and is adapted to optionally receive a spline 70 therein, as will be discussed in greater detail hereinafter. Clip 52 further includes a projection 72 extending away from wall panel 22 and terminating at a bracket engaging element, generally indicated by the numeral 74, at its end. Bracket engaging element 74 is preferably oriented so that it is substantially parallel to body portion 27 of wall panel 22, and has a first shoe portion 76 on one side of projection 72 extending toward the interior of wall panel 22, and a second shoe portion 78 on the other side of projection 72 extending outwardly from wall panel 22. In one or more embodiments, first shoe portion 76 includes a protrusion 80, preferably near its end interiorly of wall panel 22, and on the side facing wall panel 22.

With reference particularly to FIG. 2, the interrelation of mounting bracket 54 and clips 52 can be seen. A clip 52 secured to a bottom flange 38 of upper wall panel 22 is engaged with top channel 60 of mounting bracket 54. More specifically, second shoe portion 78 rests within top channel 60 and supports and anchors wall panel 22. Another clip 52 secured to a top flange 36 of lower wall panel 22 is engaged with bottom channel 62 of mounting bracket 54. In particular, protrusion 80 (FIG. 3) of first shoe portion 76 of engaging element 74 snaps into place over protrusion 64 in bottom channel 62, thereby providing secure attachment of clip 52 to mounting bracket 54.

As is apparent from the drawings, a single mounting bracket 54 thus provides mounting channels for the bottom of one wall panel 22 and the top of another wall panel 22. It should be appreciated that in one or more embodiments, clips 52 and mounting brackets 54 may also be provided on the vertical flanges of wall panels 22. In particular, additional clips may be used, and may be necessary, in cases where wall panel 22 has a significant height and therefore requires additional support along its vertical flanges. Clips 52 are interchangeable within attachment system 50, meaning that a clip 52 may be used on an top flange 36, a bottom flange 38, or vertical flanges. A fastener 84, as shown in FIG. 2, passes through bottom channel 62 and a second shoe portion 78 of engaging element 74 to secure clip 52 to mounting bracket 54. However, in a preferred embodiment of the invention, fastener 84 is used in only in a single clip 52 or, optionally, a pair of clips 52 positioned near the center of flange 36 or flange 38, while the remaining clips 52 along the flanges are not secured to mounting bracket 54 by a fastener. Such an arrangement secures wall panel 22 in place within wall panel system 20, while also allowing for thermal expansion of wall panel 22 in multiple directions from the center of the flanges. In this way wall panels 22 may be securely attached to building surface 24 without inhibiting thermal size variations in wall panel system 20.

Figure 5:
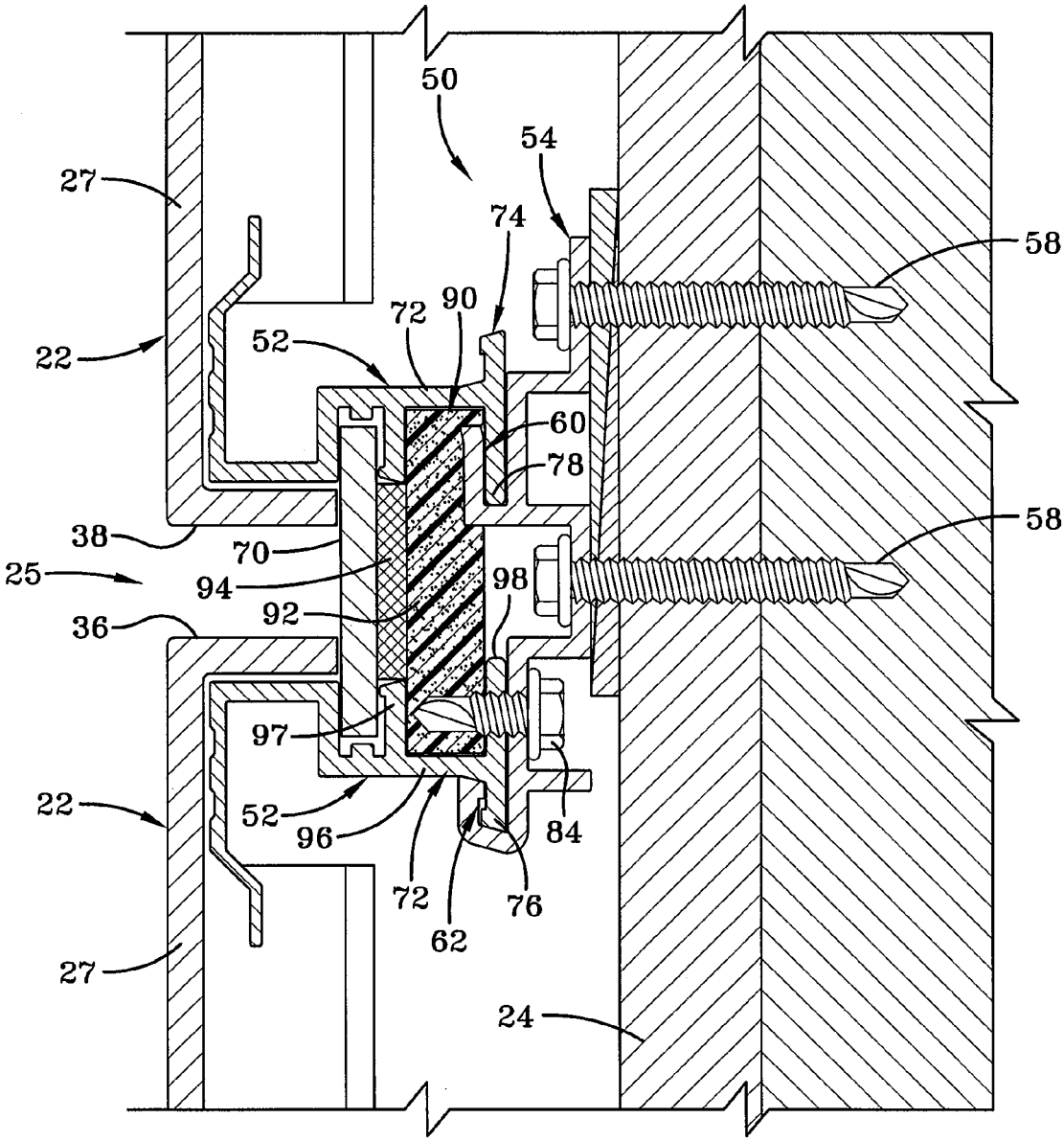
FIG. 5 is a sectional view of a portion of the wall system as shown in FIG. 2, wherein an insert is included according to at least one embodiment of the present invention and wherein the mounting bracket is not shown.

As can be seen in FIGS. 2 and 5, and as previously mentioned, one or more embodiments of attachment system 50 may include a spline 70 positioned within opposing slots 68. Spline 70 is a narrow strip that may be made of metal, plastic, a composite material, or any other suitable, weather resistant material. Spline 70 acts to cover and to at least partially seal gap 25 between adjacent wall panels 22. Spline 70 is sized so as to fit slidingly within opposing slots 68 such that it may be inserted after placement of the panels, and also to allow for thermal expansion of wall panels 22. In at least one embodiment splines 70 run horizontally within gaps 25 between adjacent wall panels 22, as well as vertically within gaps 25 between adjacent wall panels 22. Integration of slots 68 for receiving splines 70 into clips 52 is advantageous because it reduces the number of parts in wall panel system 20 and makes installation simple and more efficient.

With reference to FIG. 5, at least one embodiment of the invention includes an insert 90 extending between adjacent clips 52. Insert 90 is positioned behind spline 70 and extends between adjacent clips 52 to provide a seal at the location where adjacent splines 70 meet. Receivers, generally indicated by the numeral 95, enclose insert 90 by a base 96 constituting a portion of projection 72, a leg being second shoe portion 78 and a spaced substantially parallel leg 97 being a wall of slot 68. Specifically, insert 90 is provided at the corners of wall panels 22 where a horizontal gap 25 intersects with a vertical gap 25.

Figure 7:
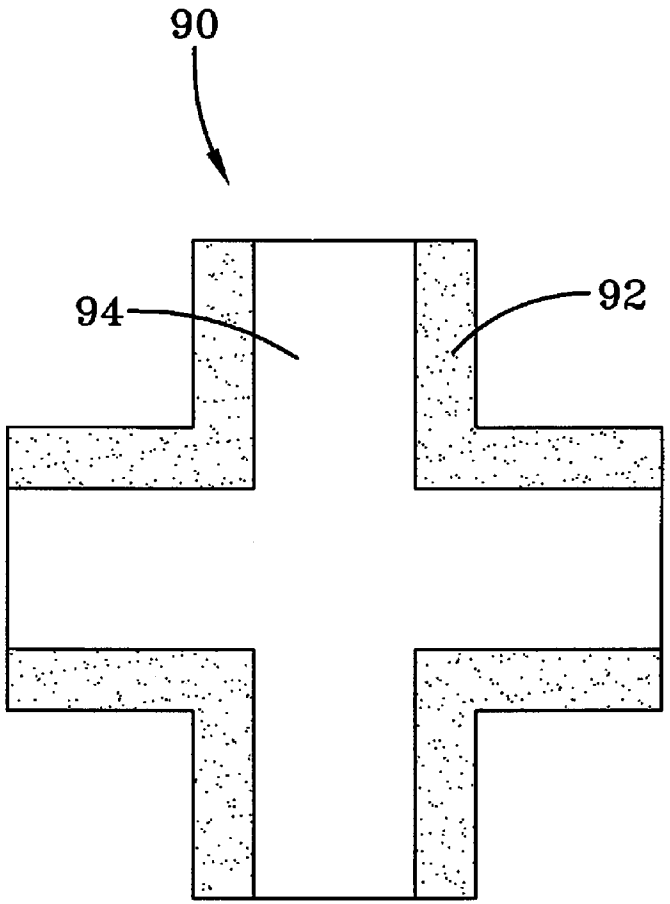
FIG. 7 is a top view of the foam insert of FIG. 5.
Figure 6:
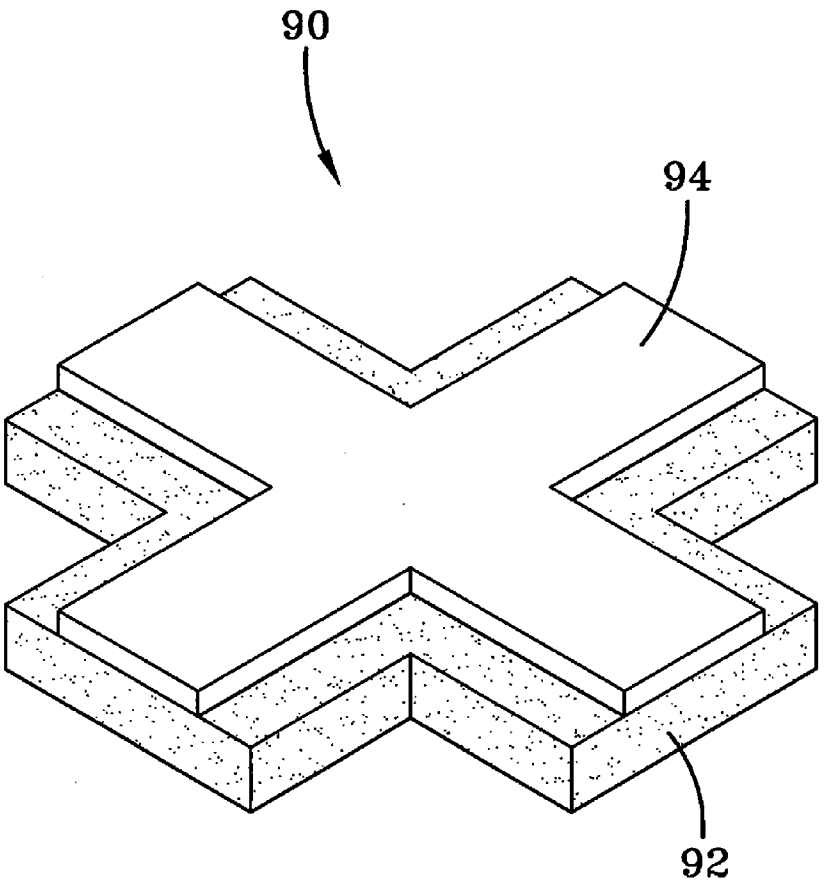
FIG. 6 is a perspective view of an insert according to an embodiment of the present invention.

As seen in FIGS. 6 and 7, insert 90 is generally cross-shaped, or X-shaped, having a vertical portion intersected by a perpendicular horizontal portion. This shape allows insert 90 to be positioned within gaps 25 at the corners of wall panels 22, and fill the space within clips 52 in all 4 directions. Where an insert 90 is used on an edge where only two wall panels 22 meet, it may be cut to fit the cavity available, thus removing the need for production of variably sized and shaped inserts to be used in various locations throughout the wall panel system 20. In one or more embodiments, insert 90 may include a foam body 92 and a gasket tape 94 interposed between foam body 92 and splines 70. Foam body 92 can be larger in size than gasket tape 94 and thereby fit between receivers 95 of opposing clips 52 adjacent to slots 68. Foam body 92 may be made from thermosetting or thermoplastic foams. It should be appreciated, however, that foam body 92 may be made from other materials without deviating from the scope of the invention. In one or more embodiments foam body 92 may be made of a foamed polyolefin, such as, for example, foamed polypropylene.

In one or more embodiments foam body 92 is made from 2.8 pcf polypropylene foam. In the same or other embodiments, gasket tape 94 may be made from EMI 108 PVC gasket tape, although gasket tape 94 may be made from any suitable material which will provide an adequate seal. Gasket tape 94 rests against spline 70 within attachment system 50 to provide the desired seal against water and air infiltration.

Various modifications and alterations that do not depart from the scope and spirit of this invention will become apparent to those skilled in the art. This invention is not to be unduly limited to the illustrative embodiments set forth herein.

What is claimed is:

1. A wall panel system comprising:

(a) a mounting bracket secured to a wall surface;

(b) a wall panel having a return flange;

(c) a clip attached to said return flange, said clip having an engaging element that secures said clip to said mounting bracket, (d) a slot in said clip facing outwardly from said wall panel;

(e) a spline slidably positioned in said slot of said clip; and (f) a sealing insert with two perpendicular and intersecting elements positioned between said mounting bracket and said spline, said sealing insert having a foam body and a gasket interposed between said spline and said foam body.

2. The wall panel system of claim 1, where said foam body is made of polypropylene foam.

3. The wall panel system of claim 1, where said gasket is a gasket tape made of PVC.

4. A wall panel system comprising:

(a) a mounting bracket having a longitudinally extending first channel and a longitudinally extending second channel;

(b) at least two wall panels positioned adjacent to one another, each having a perpendicular flange extending from two opposing edges thereof;

(c) a clip attached to each said wall panel adjacent each said flange, said clips having a slot facing outwardly from said wall panel flange and said clips having an engagement element with a first portion and a second portion;

(d) a spline slidably positioned in said slots of two adjacent clips; and (e) a sealing insert having two perpendicular and intersecting elements, said sealing insert having a foam body positioned between said mounting bracket and said spline;

wherein said clips are attached to said wall panels on a top edge and a bottom edge, with said first portion mating with said second channel of said mounting bracket along said top edge and said second portion mating with said first channel along said bottom edge.

5. The wall panel system of claim 4, said sealing insert having a gasket interposed between said spline and said foam body.

6. The wall panel system of claim 5, where said foam body is made of polypropylene foam.

7. The wall panel system of claim 5, where said gasket is a gasket tape made of PVC.

8. A wall panel system for attachment to a building surface, the system comprising:

(a) a plurality of mounting brackets attached to a surface;

(b) a plurality of wall panels having at least two return flanges, the wall panels positioned adjacent to one another and separated by gaps, said gaps positioned over said mounting brackets;

(c) a plurality of clips attached to said return flanges of said wall panels, said clips having a slot facing outwardly toward said gaps;

(d) a plurality of splines slidably positioned within and between two adjacent and opposing slots of adjacent clips and in said gaps; and (e) a sealing insert having a foam body with two intersecting elements oriented generally perpendicular to one another, the sealing insert positioned between said spline and said mounting bracket at the intersection of two perpendicular gaps.

9. The wall panel system of claim 8, wherein said clips are secured to said mounting brackets, and said mounting brackets are secured to the building surface by mechanical fasteners.

10. The wall panel system of claim 8, wherein said sealing insert is positioned at the intersection of four wall panels.

11. The wall panel system of claim 8, wherein said sealing insert further includes a gasket interposed between said spline and said foam body.

12. The wall panel system of claim 8, wherein said foam body is made of polypropylene foam.

13. The wall panel system of claim 11, wherein said gasket is a gasket tape made of PVC.

14. The wall panel system of claim 8, wherein said mounting brackets have a longitudinally extending first channel and a longitudinally extending second channel.

15. The wall panel system of claim 14, wherein said clips include an engagement element having a first portion and a second portion.

16. The wall panel system of claim 15, wherein said clips are attached to said return flanges of said wall panels on a top edge and a bottom edge of said wall panel, with said first portion of said engaging element mating with said second channel of said mounting bracket along said top edge and said second portion of said engaging element mating with said first channel along said bottom edge.

17. The wall panel system of claim 8, wherein each of said clips include an engaging element carried by a projection, and wherein each of said clips include a receiver defined by said engaging element, said projection, and a wall of said slot, said receiver adapted to receive a portion of said sealing insert.

* * * * *